US006425492B1

(12) United States Patent
Ekkert

(10) Patent No.: US 6,425,492 B1
(45) Date of Patent: Jul. 30, 2002

(54) TABBED LINER

(75) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 0 days.

(21) Appl. No.: 10/058,469

(22) Filed: Jan. 28, 2002

(51) Int. Cl.[7] ..... B65D 39/00
(52) U.S. Cl. ..... 220/349; 215/350
(58) Field of Search ..... 215/349, 350

(56) References Cited

U.S. PATENT DOCUMENTS 5,372,268 A * 12/1994 Han ..... 215/349
5,513,781 A * 5/1996 Ullrich et al. ..... 215/349
5,551,608 A * 9/1996 Moore et al. ..... 215/349
5,896,686 A * 4/1999 Howgs ..... 215/349
5,927,530 A * 7/1999 Moore ..... 215/349

* cited by examiner

*Primary Examiner*—Joseph Man Moy
(74) *Attorney, Agent, or Firm*—Welsh & Katz, Ltd.

(57) ABSTRACT

The invention relates to a liner for use with an associated closure of an associated container. The liner comprises a central portion that has a periphery. The periphery defines a central portion diameter. At lest six tabs extend from the periphery, and each tab has a tab height. Each of the at least six tabs is about 20° to about 40° in arcuate length, and the tab height is about 1 percent to about 3 percent of the central portion diameter. Each of the six tabs is equally spaced from one another.

19 Claims, 3 Drawing Sheets

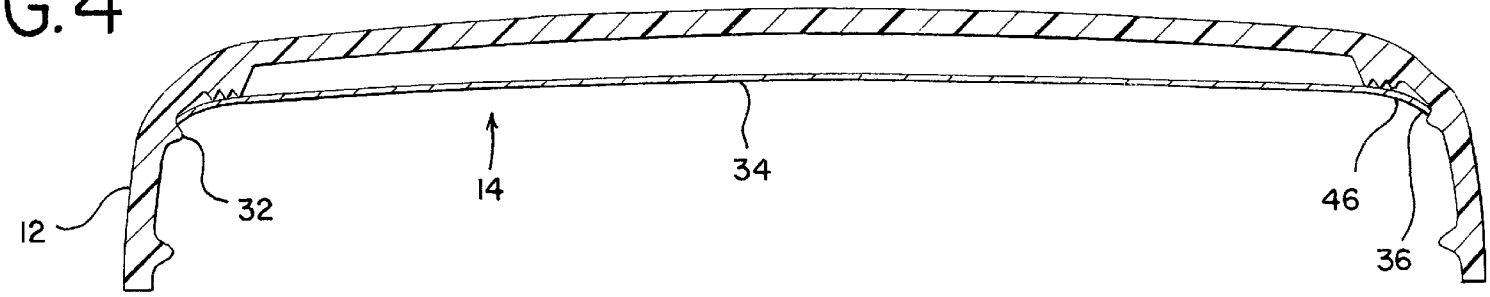
FIG.4
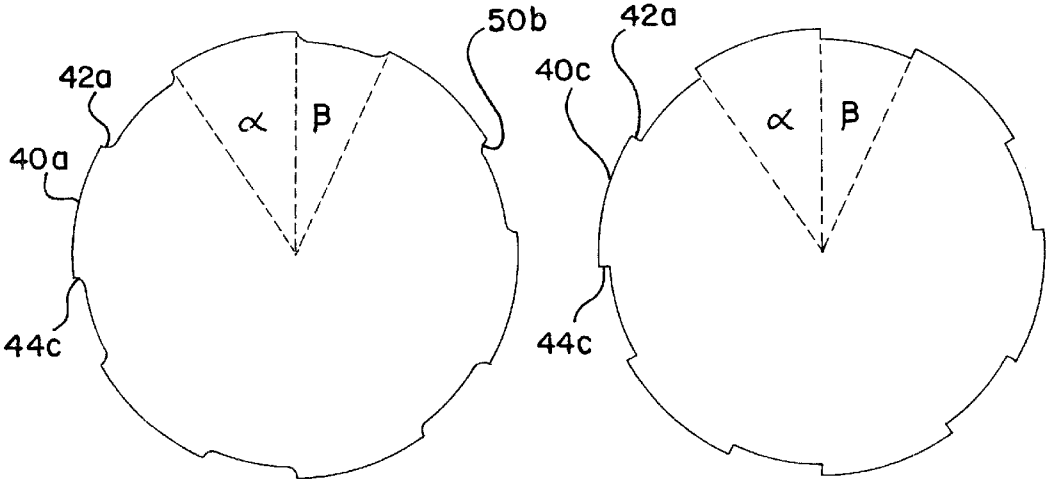
FIG.5a
FIG.5b
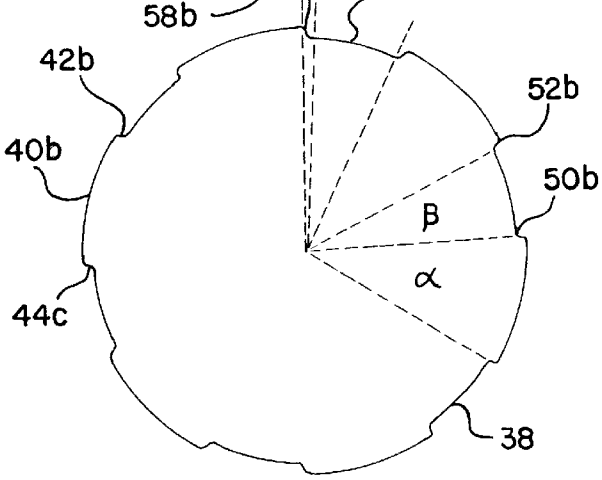
FIG.5c

TABBED LINER

BACKGROUND OF THE INVENTION

This invention relates to a closure liner having six tabs.

Container closures are available in a variety of configurations and constructions. One type of closure includes a threaded cap portion that threadedly engages a complementary thread on a container neck. Another type of closure includes a snap-type cap having a locking bead around a portion of the cap depending skirt, that engages a complementary locking portion on a container.

In order to provide visibly discernable evidence of tampering, a number of tamper indicating configurations have come into widespread use. In one type of tampering indicating arrangement, the closure cap includes a tamper evident band that depends from the cap skirt. The band fractures or separates, either fully or partially, from the skirt portion as the cap is removed from the cover to provide tamper indication.

Another arrangement includes a sealing liner positioned in the closure above a retention feature of the closure. The closure is positioned atop the container. The liner is then sealed, such as by heat sealing, to the sealing edge of the container neck. In this manner, access to the inside of the container is possible only by breaking or removing the liner from the container.

In one known liner arrangement, a pull tab is formed as part of the liner. The pull tab can be configured to retain the liner in the closure prior to applying the closure to a container. The tab can also be configured to facilitate removing the liner from the container.

In some known arrangements, the liner contains a plurality, for example three such tabs. The pull tab is a relatively small, integral extension of the liner that extends beyond the periphery of the liner that is sealed to the container neck edge.

Previous liners having three tabs incorporate tabs of inefficient arcuate length and height, and were thus encumbered by several shortcomings. For example, the inefficient arcuate length of the tabs can cause the tabs to bend along a radial flex line too far radially inward when the liner is positioned within the closure cap. This can result in an ineffective seal between the liner and the container and dust seepage into the container. Further, inefficient tab height can cause excessive friction between the tabs and the retention feature, causing additional dust particles to form.

In addition, the inefficient arcuate length and height of the tabs can also substantially increase manufacturing costs by requiring different liners for cooperation with closure caps of different sizes—as opposed to allowing one liner to cooperate with several closure caps.

Thus, there remains a need for a six tabbed liner that alleviates the shortcomings of previous liners. Liners of the invention have several attributes, among which are alleviating the shortcomings of previous liners.

SUMMARY OF THE INVENTION

The invention relates to a liner for use with an associated closure of an associated container; The associated closure defines a closure diameter. The liner comprises a circular central portion which includes a periphery. The circular central portion defines a central portion diameter which typically ranges from about 45 mm to about 130 millimeters. At least six tabs extend from the periphery, and define a tab diameter. Generally, the tab diameter is greater than the closure diameter, and when the liner is positioned within the associated closure, the tabs bend along a radial flex line.

Preferably, six tabs extend from the liner and each of the six tabs is about 20° to about 40° in arcuate length. In the six tab embodiment, each of the six tabs is equally spaced from one another. The arcuate length and spacing of the tabs allow the radial flex line to be substantially adjacent the periphery when the liner is positioned within the closure.

In addition, the tab can have several configurations and shapes. Each tab includes a top edge, a left edge, and a right edge. In a first shape, the right and left edges of each tab are transverse with the top edge of each tab, and the right and left edges form an arcuate comer with the periphery.

In a second shape, the right and left edges form an arcuate comer with the top edge and the periphery. In a third shape, the right and left edges are transverse with the top edge and the periphery.

BRIEF DESCRIPTION OF THE FIGURES

The benefits and advantages of the present invention will become more readily apparent to those of ordinary skill in the relevant art after reviewing the following detailed description and accompanying drawings, wherein:

FIG. 4 shows a cut-away side view of FIG. 3; and,

FIG. 5*a*–5*c* show three different liners incorporating aspects of the invention, each liner incorporating a different tab shape and configuration.

DETAILED DESCRIPTION OF THE INVENTION

Figure 1:
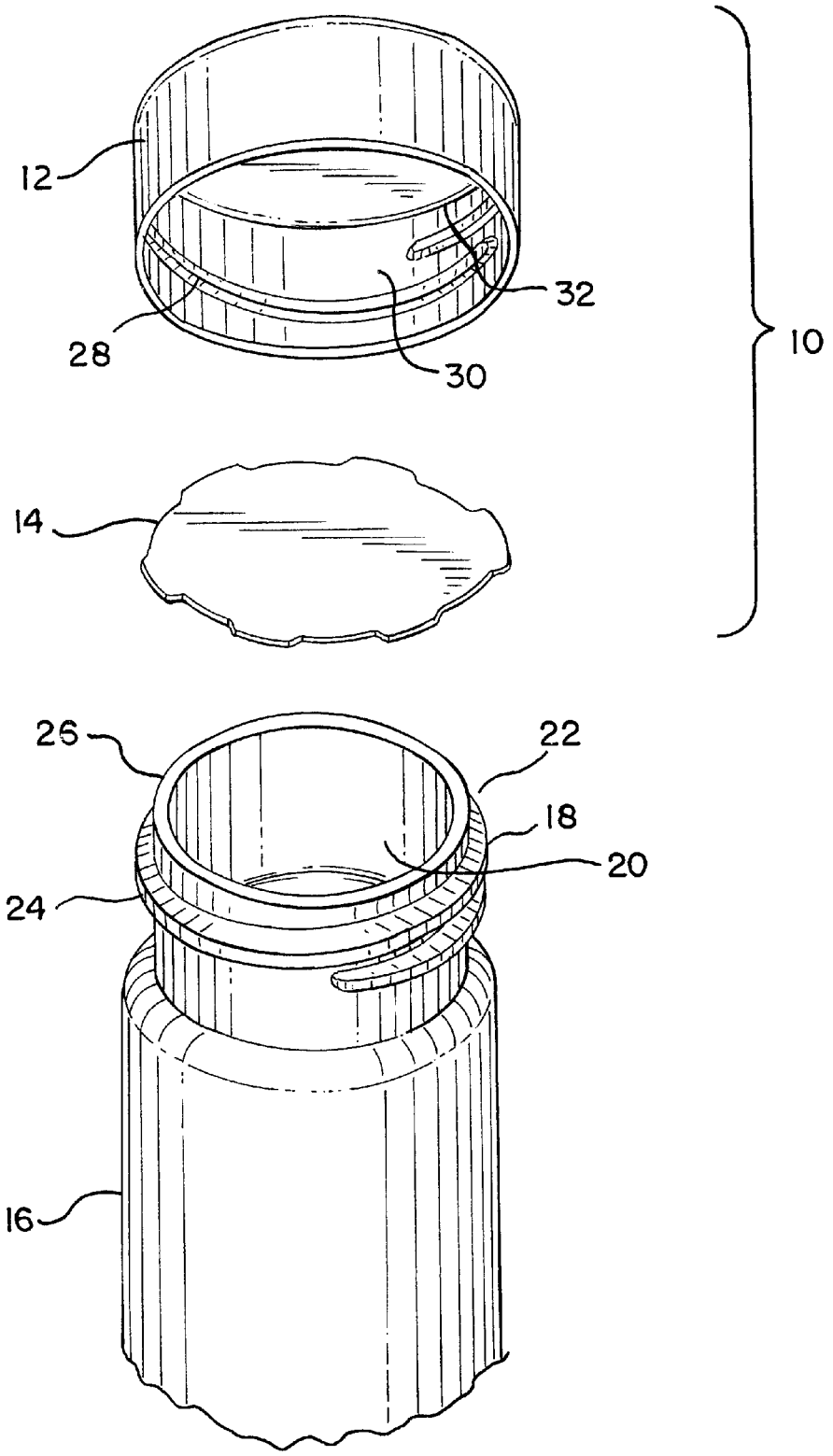
FIG. 1 shows an exploded view of a closure package, which includes a liner embodying principles of the invention and a closure cap, in cooperation with a container.

While the present invention is susceptible of embodiment in various forms, there is shown in the drawings and will hereinafter be described a specific embodiment with the understanding that the present disclosure is to be considered an exemplification of the invention and is not intended to limit the invention to the specific embodiment illustrated. It should be further understood that the title of this section of this specifically, normally, "Detailed Description of the Invention," relates to a requirement of the United States Patent and Trademark Office, and does not imply, nor should be referred to limit the subject matter disclosed and claimed herein.

FIG. 1 shows a closure package 10 including a closure cap 12 and a liner 14 embodying the principles of the present invention. The package 10 is for use with an associated container 16. The exemplary container 16 has a finish 18 having a threaded neck portion 20. The finish 18 is that portion of the container 16 including the upper region 22 which engages the closure cap 12, e.g. container threads 24 and an uppermost sealing surface 26 of the container 16. The container threads 24 engage complementary threads 28 formed on an inner surface 30 of the closure cap 12. The closure cap 12 shown in FIG. 2–3 also includes a retention feature 32, such as an annular ridge 32, for cooperation with the liner 14; The retention feature 32 defines a closure diameter CD.

Those skilled in the art will recognize that the present invention functions with other closure caps and containers that have a snap-on arrangement (not shown) so that the closure caps snap onto the container (and thus do not require 'screwing' the closure cap onto the container). In other embodiments not shown, the threading 24 of the closure cap 12 or a snap on feature (not shown) can serve as the retention feature.

The liner 14 has a central portion 34 that is positioned over, and sealed to, the sealing surface 26 of the container 16, as shown in FIG. 1. In the preferred embodiment of FIG. 2, six tabs 36 that are integral with the central portion 34 extend from the periphery 38 of the liner 14. In other embodiments (not shown), there may be more tabs used, as will become apparent. The tabs 36 can serve as grasping portions, outside of the sealed periphery 38 of the central portion 34, that facilitate removing the liner 14 from the container 12.

Those skilled in the art will recognize that the liner 14 can be formed from a variety of materials, including foil, fibrous, e.g., pulp-based material, polymeric materials such as polyethylene, resilient materials e.g., closed cell foams, and the like. Such liners 14 can also be formed from a laminate including any of the aforementioned liner materials. Such a laminate can include a foil element to provide gas impermeability characteristics for the liner. Typically, such a liner 14 includes a heat activated bonding layer such as a heat activated adhesive, applied to the liner 14 on a side adjacent to the container sealing surface 26. Such liners 14 permit the cap 12 to be closely fitted to, and tightened onto, the container 16. Further, those skilled in the art will recognize that liners of the invention can be of varying thickness.

Figure 2:
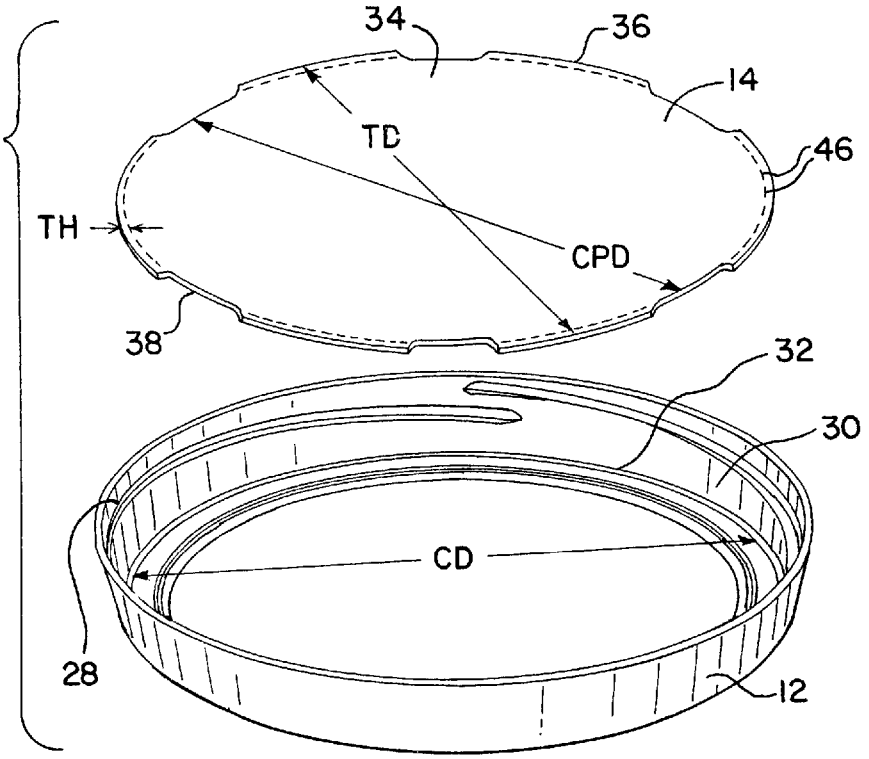
FIG. 2 shows an exploded view of closure package including a liner embodying principles of the invention and a closure cap.

As can be seen from the preferred embodiment of FIG. 2, six tabs 36 extend from the periphery 38 of the central portion 34 of the liner 14. Each tab 36 has a top edge 40, a right edge 42, and a left edge 44 (FIGS. 5*a*–5*c*). The central portion 34 of the liner 14 defines a central portion diameter CPD, the tabs 36 define a tab diameter TD, and the retention feature 32 defines a closure diameter CD. The tab diameter TD is typically greater than the closure diameter CD to allow for liner/closure 14, 12 cooperation.

Figure 3:
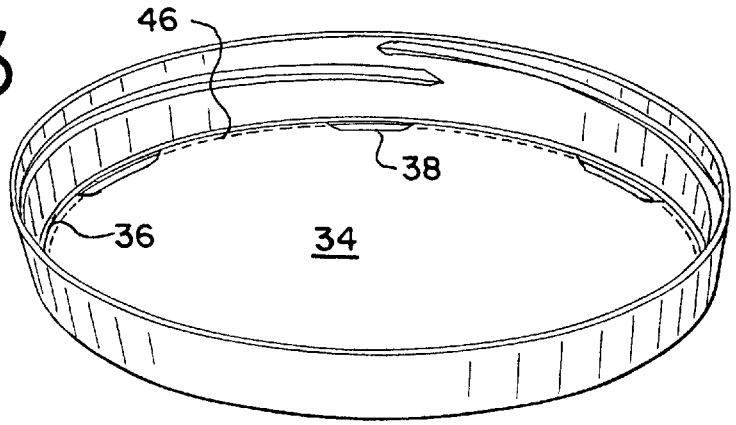
FIG. 3 shows a bottom view of the liner of FIG. 2 in cooperation with the closure cap of FIG. 2.

In a typical assembly operation, the liner 14 is formed separately from the closure 12. As shown in FIG. 2–3, the liner 14 is fitted within the inside of the closure cap 12, and may be positioned above the retention feature 32. In other embodiments not shown, the liner may be positioned below part of the retention feature if, for example, as described above, the retention feature is threading—then the liner may be positioned above a portion of the threading and below another portion of the threading. Also, the liner may be positioned below a portion of the retention feature if, for example, the retention feature comprises a bead and threading—then the liner may be positioned below the retention feature (for example a bead) but above the threading. The liner 14 cooperates with the retention feature and is maintained within the closure cap 12. The closure 12, with the liner 14 positioned therein, can then be stored or shipped to a bottling or canning facility. Customarily, at the bottling or canning facility, the closure 12 is positioned on the container 16, and the liner 14 is sealed to the container 16 by methods that will be recognized by those skilled in the art.

Previous liners having a plurality of tabs incorporated tabs of various arcuate length and height were encumbered by several shortcomings. For example, the arcuate length of the tabs of previous liners can cause the tabs to bend along a radial flex line too far radially inward when the liner is positioned within the closure cap. The radially inwardly positioned radial flex line causes excessive bending of the liner and results in an inefficient seal with the associated container—when the liner is eventually sealed to the associated container (as described above). In addition, dust particles generally form on the liner, and because of excessive liner bending, the dust particles creep onto the top of the ridge. This condition often results in consumer complaints about perceived contamination.

Further, tab heights incorporated in previous liners can cause excessive friction between the tabs and the retention feature, if used. This causes additional dust particles to form, which may add to unwanted dust (described above).

The arcuate length and height of the tabs of previous liners can also substantially increase manufacturing costs with respect to the number and type of liners required for closure caps of different sizes. For example, closure caps typically have tolerances of +/−0.016 inches, and thus require liners that bend in a particular location to reduce dust particle seepage and friction. Because of varying sizes of the same nominally sized closure caps (typically varying by the color of the closure cap), previous liners required a separate liner size to cooperate with each different color closure cap of the same nominal size.

The shortcomings of previous liners are alleviated when using liners 14 of the invention. For example, as shown in FIG. 4, the radial flex lines 46 along which the tabs 36 bend are positioned substantially along the periphery 38 of the liner 14, allowing for effective liner sealing with the container 16 and reduced dust seepage. As shown in FIGS. 2 and 5*c*, such radial flex lines 46 are substantially straight but follow a slightly outwardly shaped arch in the middle of the radial flex line 46. Thus, the radial flex lines 46 bend outwardly, avoiding the sealing surface 26 of the associated container 16 during capping operations. This allows for effective seals between the liner 14 and the associated container 16.

As shown in FIGS. 5*a*–5*c*, liners 14 of the invention incorporate optimal arcuate tab length $\alpha$, optimal arcuate spacing between the tabs $\beta$, and tab height dimensions TH (FIG. 2). Table 1 (below) lists optimal arcuate tab length $\alpha$, optimal arcuate spacing between the tabs $\beta$, and tab height TH dimensions for the six tabbed liner shown in FIGS. 2 and 5. Those skilled in the art recognize that the dimensions listed in Table 1 are not comprehensive of all possible dimensions. Note that all dimensions listed are nominal dimensions. Thus, for example, the closure cap listed as having an outer diameter of 55 mm can have a range of about 54.5 mm to about 55.5 mm. Further, although not listed in Table 1, some caps have an outer diameter greater than 110 mm while others have an outer diameter less than 55 mm. Caps having a diameter greater than 110 mm typically have tabs of about 40° in arcuate length ($\alpha$). Typically outer diameter closure cap dimensions vary from about 45 mm to about 110 mm.

TABLE 1

| | | | | | | | |
|---|---|---|---|---|---|---|---|
| Outer diameter of closure cap (mm) | 55 | 63 | 70 | 71 | 80 | 88 | 110 |
| Central Portion Diameter (mm) | 55.093 | 60.452 | 66.802 | 67.640 | 76.124 | 81.250 | 107.950 |
| tab diameter (mm) | 57.223 | 62.230 | 69.596 | 69.342 | 78.029 | 85.192 | 110.490 |
| α(°) | 35 | 35 | 35 | 35 | 35 | 35 | 40 |
| β(°) | 25 | 25 | 25 | 25 | 25 | 25 | 20 |
| Tab Height (mm) | 1.067 | 0.889 | 1.397 | 0.851 | 0.953 | 1.969 | 1.270 |
| Tab Height % of Central Portion Diameter | 1.94% | 1.47% | 2.09% | 1.26% | 1.25% | 2.42% | 1.18% |

Further, the liners 14 of the invention can incorporate tabs 36 of varying shapes and configurations, such as those shown in FIGS. 5*a–c*. In particular, FIG. 5*a* shows a first tab shape 48*a* in which the right and left edges 42*a*, 44*a* form an arcuate corner 50*a* with the periphery 38. Preferably, the arcuate corner is concave when viewed from a vantage point exterior to the liner 14. The right and left edges 42*a*, 44*a* are substantially transverse to the top edge 40*a*, and preferably straight and substantially perpendicular to the top edge 40*a*.

In the second tab shape shown in FIG. 5*b*, the right and left edges 42*b*, 44*b* form an arcuate corner 50*b* with the periphery 38 and the top edge 40*b*. Preferably, the arcuate corner 50*b* between the right and left edges 42*b*, 44*b* and the top edge 40*b* is convex when viewed from a vantage point exterior to the liner 14. Preferably, the arcuate comer 50*b* between the right and left edges 42*b*, 44*b* and the periphery 38 is concave when viewed from a vantage point exterior to the liner 14. In the second shape 48*b*, spacing 54 between each tab 36 includes a peripheral portion 56*b*. The second shape 48*b* also include a corner portion 58*b*, which includes a portion of the tab 36 and the peripheral portion 56*b* adjacent the ends of each tab 36.

FIG. 5*c* shows a third tab shape 48*c* in which the right and left edges 42*c*, 44*c* are substantially transverse, and preferably, are substantially perpendicular, to the top edge 40*c* and periphery 38 of the liner 14.

From the foregoing it will be observed that numerous modifications and variations can be effectuated without departing from the true spirit and scope of the novel concepts of the invention. It is to be understood that no limitation with respect to the specific embodiment illustrated is intended or should be inferred. The disclosure is intended to cover by the appended claims all such modifications as fall within the scope of the claims.

What is claimed is:

1. A liner for use with an associated closure of an associated container, the liner comprising:

a central portion including a periphery, the central portion defining a central portion diameter;

at least six tabs extending from the periphery, each tab having a tab height;

each of the at least six tabs being about 20° to about 40° in arcuate length, the tab height being about 1 percent to about 3 percent of the central portion diameter, and each of the six tabs being equally spaced from one another.

2. The liner in accordance with claim 1 including six tabs, each tab being about 35° to about 40° in arcuate length.

3. The liner in accordance with claim 1 wherein the tabs define a tab diameter and the associated closure defines a closure inside diameter, the tab diameter being greater than the closure inside diameter, the tabs bending along a radial flex line when the liner is positioned within the associated closure, and the arcuate length of the tabs and arcuate spacing between the tabs allowing the radial flex line to be substantially adjacent the periphery when the liner is positioned within the closure.

4. The liner in accordance with claim 1 wherein each tab includes a top edge, a left edge, and a right edge, the right and left edges forming an arcuate corner with the top edge and the periphery.

5. The liner in accordance with claim 4 wherein the spacing between the tabs includes a peripheral arcuate length, the top edge being about 32° in arcuate length and the peripheral arcuate length being about 22°.

6. The liner in accordance with claim 1 wherein each tab includes a top edge, a left edge, and a right edge, the right and left edges being substantially transverse with the top edge, and the right and left edges forming an arcuate corner with the periphery.

7. The liner in accordance with claim 1 wherein each tab includes a top edge, a left edge, and a right edge, the right and left edges being substantially transverse with the top edge and the periphery.

8. The liner in accordance with claim 1 wherein the central liner portion diameter is less than 130 millimeters and each of the six tabs are about 35° in arcuate length.

9. The liner in accordance with claim 8 wherein the central portion diameter is about 67 millimeters and the tabs define a tab diameter of about 70 millimeters.

10. The liner in accordance with claim 1 wherein the central portion diameter is greater than 130 millimeters and each of the six tabs being about 40° in arcuate length.

11. The liner in accordance with claim 1 wherein the liner is comprised of polyethylene material, polypropylene material, or pulp material.

12. A liner for use with an associated closure of an associated container, the associated closure defining a closure diameter, the liner comprising:

a circular central portion including a periphery, the circular central portion defining a central portion diameter less than 130 millimeters;

at least six tabs extending from the periphery, the tabs defining a tab diameter;

the tab diameter being greater than the closure diameter, the tabs bending along a radial flex line when the liner is positioned within the associated closure, each of the at least six tabs being about 25° to about 35° in arcuate length and having a tab height of about 1 to about 3 percent of the central portion diameter, each of the six tabs being spaced from one another by about 15° to about 25° in arcuate length so that the arcuate length and spacing of the tabs allow the radial flex line to be substantially adjacent the periphery when the liner is positioned within the closure.

13. The liner in accordance with claim 12 including six tabs, each tab being about 35° in arcuate length and the spacing between each tab being about 25°.

14. The liner in accordance with claim 12 wherein each tab includes a top edge, a left edge, and a right edge, the right and left edges forming an arcuate corner with the top edge and the periphery.

15. The liner in accordance with claim 12 wherein each tab includes a top edge, a left edge, and a right edge, the right and left edges being transverse with the top edge, and the right and left edges forming an arcuate corner with the periphery.

16. The liner in accordance with claim 12 wherein each tab includes a top edge, a left edge, and a right edge, the right and left edges being transverse with the top edge and the periphery.

17. A liner for use with an associated closure of an associated container, the associated closure defining a closure diameter, the liner comprising:

a circular central portion including a periphery, the circular central portion defining a liner diameter greater than 130 millimeters;

at least six tabs extending from the periphery, the tabs defining a tab diameter;

the tab diameter being greater than the closure diameter, the tabs bending along a radial flex line when the liner is positioned within the associated closure, each of the six tabs being about 30° to about 40° in arcuate length and having a tab height of about 1 to about 3 percent of the central portion diameter, each of the six tabs being spaced from one another by about 10° to about 20° in arcuate length so that the arcuate length and spacing of the tabs allow the radial flex line to be substantially adjacent the periphery when the liner is positioned within the closure.

18. The liner in accordance with claim 17 including six tabs, each tab being about 40° in arcuate length.

19. The liner in accordance with claim 17 wherein each tab includes a top edge, a left edge, and a right edge, the right and left edges forming an arcuate corner.

* * * * *